US008899216B2

(12) United States Patent
Laporte et al.

(10) Patent No.: US 8,899,216 B2
(45) Date of Patent: Dec. 2, 2014

(54) MACHINE FOR LAUNCHING TARGETS WITH IMPROVED CONTACT SURFACES

(75) Inventors: Jean-Michel Laporte, Biot (FR); Jean-Marc Fouques, Claviers (FR)

(73) Assignee: LaPorte Holding, Biot (FR)

( * ) Notice: Subject to any disclaimer, the term of this patent is extended or adjusted under 35 U.S.C. 154(b) by 108 days.

(21) Appl. No.: 13/696,284

(22) PCT Filed: May 3, 2011

(86) PCT No.: PCT/EP2011/057072

§ 371 (c)(1), (2), (4) Date: Jan. 29, 2013

(87) PCT Pub. No.: WO2011/138338

PCT Pub. Date: Nov. 10, 2011

(65) Prior Publication Data

US 2013/0118464 A1 May 16, 2013

(30) Foreign Application Priority Data

May 5, 2010 (FR) ..... 10 53484

(51) Int. Cl.

| | |
|---|---|
| ***F41J 9/18*** | (2006.01) |
| ***F41J 9/30*** | (2006.01) |
| ***A63B 69/40*** | (2006.01) |
| ***F41J 9/24*** | (2006.01) |
| ***F41J 9/20*** | (2006.01) |

(52) U.S. Cl.

CPC .... *F41J 9/30* (2013.01); *F41J 9/24* (2013.01); *F41J 9/20* (2013.01); *A63B 69/408* (2013.01); *F41J 9/18* (2013.01)

USPC ..... 124/6; 124/4; 124/7; 124/8; 124/26; 124/36; 124/43; 124/47; 124/50; 124/51.1; 124/81

(58) Field of Classification Search

CPC ..... F41J 5/18; F41J 5/30; F41J 9/18; F41J 9/30; F41J 9/20; A63B 69/408

USPC ..... 124/4, 6, 7, 8, 43, 47, 81, 26, 36, 50, 124/51.1

See application file for complete search history.

(56) References Cited

U.S. PATENT DOCUMENTS 1,374,757 A * 4/1921 Napier ..... 124/26
1,552,191 A * 9/1925 Bahlmann ..... 124/26

(Continued)

FOREIGN PATENT DOCUMENTS

DE 202004013738 12/2004

OTHER PUBLICATIONS

International Search Report from the European Patent Office dated Jun. 29, 2011, for International Patent Application No. PCT/EP2011/057072, Filed May 3, 2011, Applicant, Laporte Holding. (6 pages).

(Continued)

*Primary Examiner* — Gene Kim
*Assistant Examiner* — Alexander Niconovich
(74) *Attorney, Agent, or Firm* — McCracken & Gillen LLC

(57) ABSTRACT

A machine for launching disk-shaped targets has two faces located on each side of an edge. The machine includes means for loading a target into a launch area, an arm for launching the target placed in the launch area and a surface guiding the target by means of contact with at least one of the aforementioned faces thereof. The guiding surface has at least one portion wherein the areas that come into contact with the face of the target are not continuous. The machine is particularly suitable for shooting practice, such as archery.

7 Claims, 4 Drawing Sheets

(56) References Cited

U.S. PATENT DOCUMENTS

| | | | | | |
|---|---|---|---|---|---|
| 1,638,283 | A | * | 8/1927 | Bahlmann | 124/26 |
| 2,135,603 | A | * | 11/1938 | Roth | 124/8 |
| 3,368,542 | A | * | 2/1968 | Dale | 124/8 |
| 3,417,741 | A | * | 12/1968 | Schreiner | 124/8 |
| 3,420,218 | A | * | 1/1969 | Rademacher | 124/7 |
| 3,598,099 | A | * | 8/1971 | Luebkeman | 124/43 |
| 3,601,112 | A | * | 8/1971 | Dale | 124/8 |
| 4,220,130 | A | * | 9/1980 | Glover et al. | 124/7 |
| 4,481,932 | A | * | 11/1984 | Olson | 124/8 |
| 4,730,595 | A | | 3/1988 | Glass | |
| 4,747,390 | A | * | 5/1988 | Storm | 124/6 |
| 5,050,575 | A | * | 9/1991 | Killion | 124/8 |
| 5,140,971 | A | * | 8/1992 | Heffer | 124/8 |
| 5,771,874 | A | * | 6/1998 | Kohler | 124/8 |
| 5,975,527 | A | * | 11/1999 | Winchester | 273/129 V |
| 6,276,350 | B1 | * | 8/2001 | Davey | 124/8 |
| 7,263,986 | B2 | * | 9/2007 | Lovell | 124/9 |
| 2012/0138034 | A1 | * | 6/2012 | Whidborne | 124/8 |
| 2013/0333679 | A1 | * | 12/2013 | Kroll | 124/7 |

OTHER PUBLICATIONS

European Patent Office Written Opinion for International Patent Application No. PCT/EP2011/057072, filed May 3, 2011, Applicant, Laporte Holding (4 pages).

English translation of European Patent Office Written Opinion for International Patent Application No. PCT/EP2011/057072, filed May 3, 2011, Applicant, Laporte Holding (5 pages).

* cited by examiner

MACHINE FOR LAUNCHING TARGETS WITH IMPROVED CONTACT SURFACES

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE DISCLOSURE (1) Field of the Invention

This invention relates to a machine for launching targets. It is particularly suitable for practicing shooting sports, such as archery.

In this latter field, practising can make the use of machines capable of launching targets. The most common targets are called clay pigeons or skeets and are propelled by a launch arm equipping the machine. The assembly can be motor-driven and a unit for storing multiple targets ensures repeatable and at least partially automated launching.

In practice, a target is loaded so as to reach a zone where the launch force is applied by the launch arm. Before launching, the target comes into contact with parts of the machine. In particular, during its loading and/or at the launch area, the target is controlled in position by guiding surfaces, in particular by contact with the faces of the target. This co-action between the target and the guiding components can however be improved.

(2) Description of Related Art Including Information Disclosed Under 37 CFR 1.97 and 1.98

U.S. Pat. No. 1,638,283 describes a device for launching targets. The device comprises two guiding plates separated one from the other and between which is arranged a track which the edge of the target is in contact with. The track has a high coefficient of friction. No means are provided for improving the guidance of the target.

The invention aims to improve this co-action and for this purpose proposes a machine such that the contact between the guiding surface of one or both faces of the target is at least in part by discontinuous contact zones. Although it might be thought that even and smooth guidance surfaces are required, the applicant has found surprisingly that a discontinuous contact ensures less adherence of the target on the faces of the target and has noted that this decrease in the adherence was not negligible.

For example, at the launch area, less lateral adherence favours contact with the edge of the target, thereby improving the launch trajectory and enabling the target to self-rotate, thereby enhancing the stability of the launched target.

The invention gives particular satisfaction when using disk-shaped targets including targets in plastic, such as polymer foams.

Other aims and advantages will become apparent from the following description which illustrates one embodiment of the invention, but is not restrictive.

BRIEF SUMMARY OF THE DISCLOSURE

First of all, it is recalled that the invention relates to a machine for launching disk-shaped targets with two faces on either side of an edge, and comprising means for loading a target in a launch area, a launch arm located in the launch area and a target guiding surface by contact with at least one of its faces, characterised in that the guiding surface comprises at least one portion in which the contact zones with the face of the target are discontinuous.

Preferred but not restrictive embodiments of the invention are described below and can be combined or used alternately. In these embodiments, the machine is such that:

- its discontinuous contact zones comprise zones in relief forming protuberances on the guiding surface,
- zones with protuberances forming the relief,
- zones with checkered shapes forming the relief,
- discontinuous contact zones comprising contact zones surrounded by zones with discontinuous perforations,
- the launch area comprises a surface supporting the edge of a target and at least one sidewall forming part of the guiding surface and comprising discontinuous contact zones,
- the launch area comprises two sidewalls configured to co-act with the different faces of a target and forming part of the guiding surface and comprising discontinuous contact zones,
- the supporting surface of the target comprises friction means,
- the loading means comprise an assembly for storing multiple targets and the means for delivering the targets from the storage assembly to a delivery area, the delivery area having at least one receiving surface forming part of the guiding surface,
- the receiving surface has discontinuous contact zones,
- the receiving surface and the launch area are connected by a transfer ramp configured so as to guide the target to the launch area, the transfer ramp being part of the guiding surface and having discontinuous contact zones.

The accompanying drawings are given as examples and are not restrictive. They show only one embodiment of the invention and will enable it to be easily understood.

DETAILED DESCRIPTION

Figure 1:
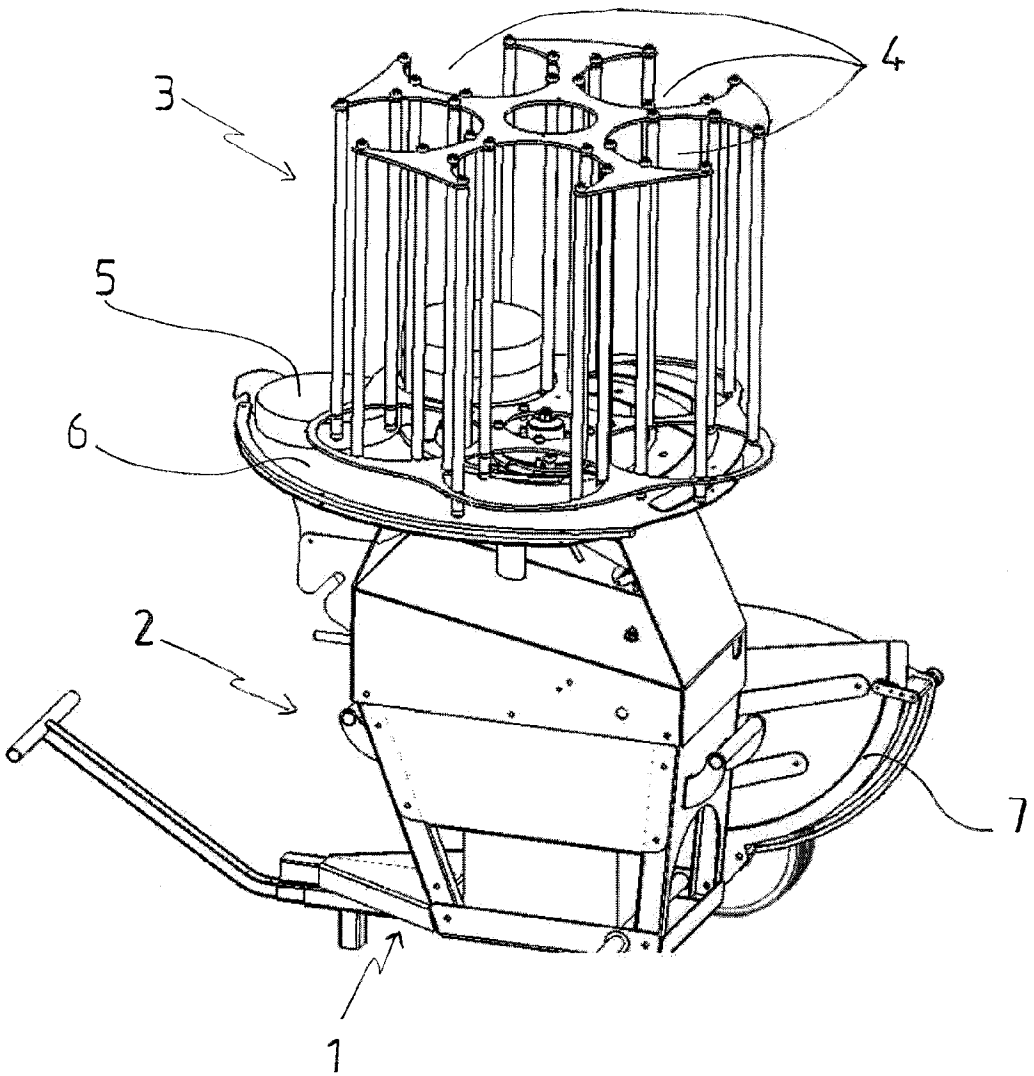
FIG. 1 shows a partial perspective view of a machine according to the invention.

In the example shown in FIG. 1, the machine comprises a base 1, equipped with means for standing on the ground, the base being surmounted by a chassis 2 capable of receiving the various components of the machine. Thus, for instance, a cylinder 3 surmounts the machine and comprises multiple columns 4 each one capable of receiving a series of targets 5 by stacking them. The number of columns 4 is not limited. In an advantageous arrangement, the cylinder 3 is mounted to rotate around an axis parallel to the longitudinal axis 4 of the column corresponding to the direction of stacking of the targets 5. The cylinder 3 is one of the components of the means for loading a target ready for launching. In a preferred embodiment, the cylinder 3 co-acts with means for delivering a target in the direction of the launch part. For example, the delivery means comprise means for releasing the target 5 located in the lowest part of one of the columns 4 while retaining the other targets 5 above it.

Figure 3:
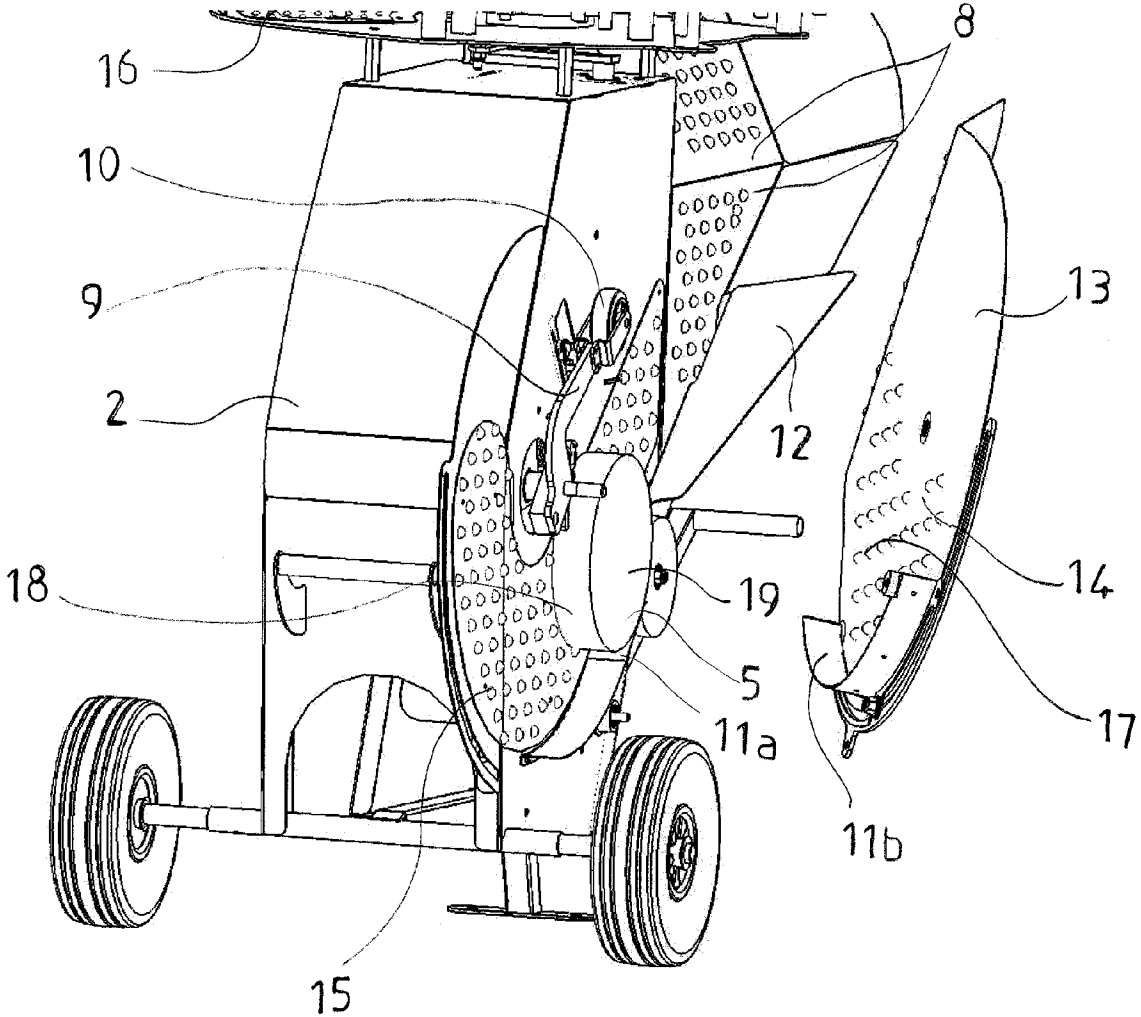
FIG. 3 shows some components on a partial exploded perspective view of the invention.
Figure 4:
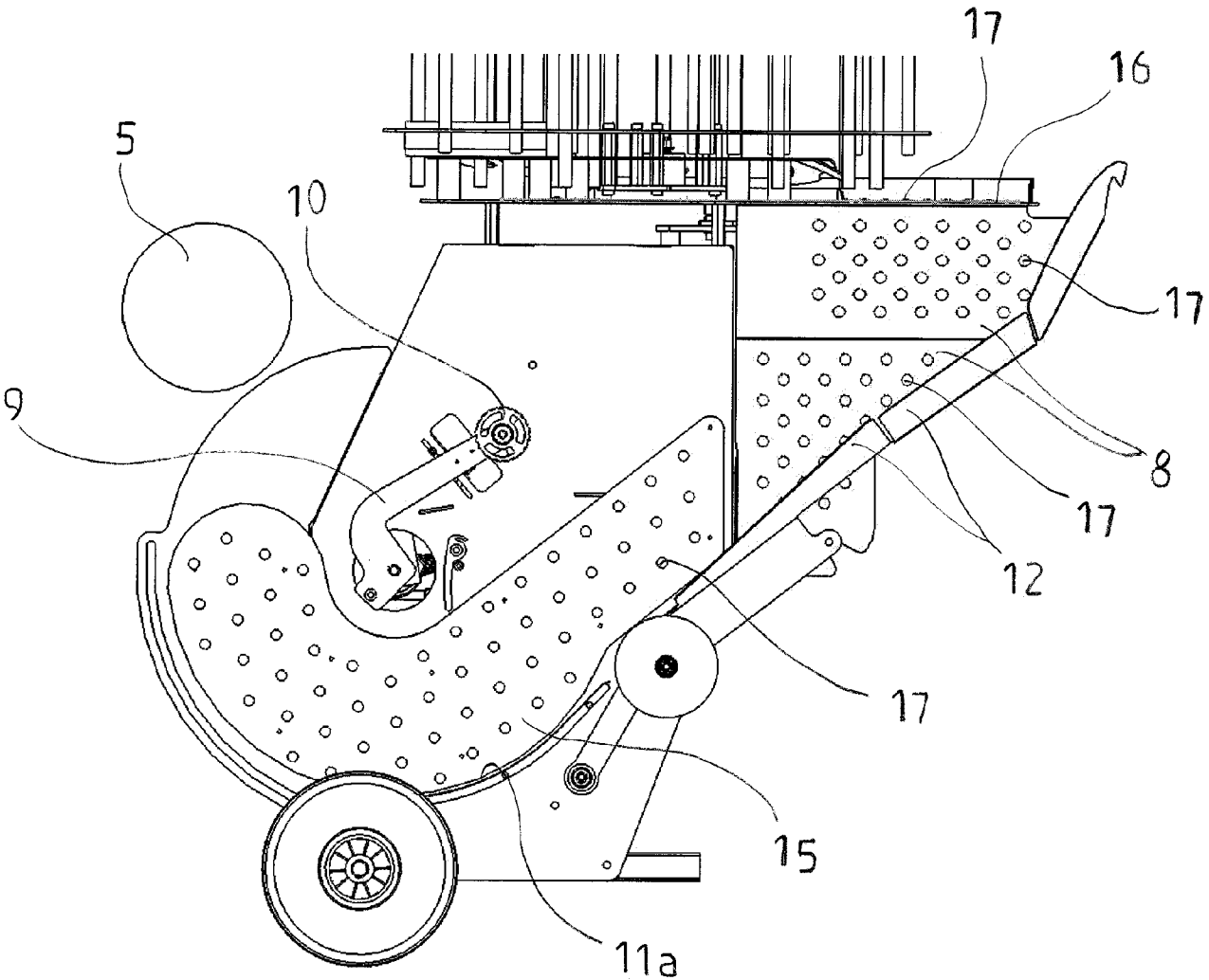
FIG. 4 is another view, in profile, of the invention illustrating certain zones of the guiding surface.

As to the launching part of the target, it can be executed by an arm 9 in the example assembled to rotate as shown in FIGS. 3 and 4. On these figures, the arm 9 is terminated by a roller 10 mounted to pivot on the rest of the structure of the arm 9, and therefore the peripheral wall forms the surface pushing on target 5.

An example of the target 5 is shown particularly in FIGS. 3 and 4, disk-shaped with a substantially flat cylindrical envelope defined by two flat faces separated by an edge 18 corresponding to the thickness of the cylindrical envelope. The section of the cylindrical envelope is circular in an advantageous embodiment, but other forms may be envisaged without this departing from the scope of the invention.

In a preferred embodiment, the invention concerns targets for archery purposes. The target 5 may be a cylindrical part measuring about 15 to 400 mm in diameter and from 30 the 150 mm thick, and more preferably for competition purposes 245 mm diameter and 50 mm thick and made of polymer foam. The target is preferably made of plastic. Optionally, the target 5 may consist of a sandwich of several layers of polymer foam particularly with a core layer that is harder than the 2 layers positioned laterally on either side of the core layer. The core layer is preferably between 20 and 90 mm thick, and especially around 30 mm. As to the outer layers, a thickness of around 7 mm to 20 mm, and especially 10 mm is particularly effective.

It will be easily understood that once delivered by the cylinder 3, the target 5 has to be transferred to a launch area in which is positioned the arm 9, and where it operates its rotational movement so as to generate push on the target 5 and achieve its ejection as shown in FIG. 4.

In a manner known per se, the movement of the arm 9 and a cylinder 3 may be motor-driven and controlled.

Figure 2:
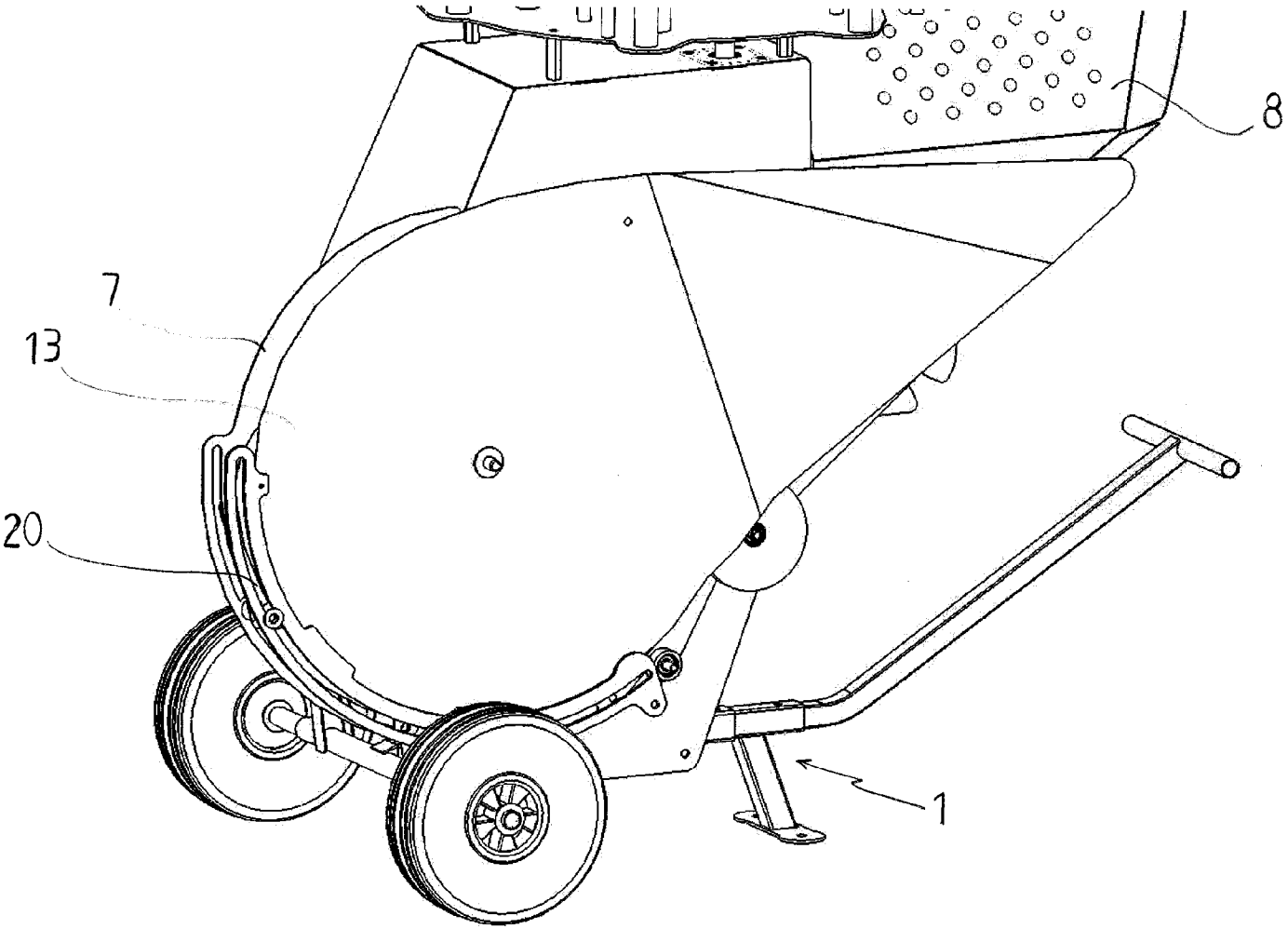
FIG. 2 is a partial perspective view from another angle.

By referring to FIG. 3, we note that the arm 9 exerts a push force on the target 3 via its edge 18. The latter bears on a supporting surface 11*a*, 11*b* with preferably a self-rotating movement. In the example shown in FIG. 3, the supporting surface 11*a*, 11*b* is made in 2 portions, each one on a different part. A first part 11*a* of the supporting surface is formed on a component fixed relative to the chassis 2 of the machine. This portion 11*a* corresponds to a first part in contact with the edge 18 of the target 5 relative to the direction of movement of the arm 9. The second portion 11*b* is formed on a part whose position between this chassis 2 and a flap 13 attached to the remainder of the machine is adjustable. The part in question advantageously consists of a carriage assembled with a possible angular adjustment relative to the rest of the machine. The movement of the carriage relative to the chassis 2 is guided for instance by the guiding means 20 shown on FIG. 2. The carriage is a support for the portion 11*b* and is guided in the guides 20 of the flap 13 and the chassis 2. An alternative consists in forming a flap 13 adjustable in the angular position and bearing the portion 11*b*. The portion 11*b* is a part downstream of the surface supporting the edge 18. The capacity to adjust the angular position of the portion 11*b* is available for adjusting the exit angle of the target 5. It will be easily understood that the more the portion 11*b* is deployed so as to increase the effective supporting surface 11*b*, the more vertical will be the exit angle. This is particularly the case shown in FIGS. 2 and 4. However, if the carriage is retracted so as to limit the effective supporting surface 11*b* the less vertical will be the exit angle of the target.

The assembly formed by the flap 13 and the opposite surface secured to the chassis 2 forms a fairing 7 enclosing the launch area in which is situated the arm 9.

The movement of the target 5, especially during the launch movement, but also possibly during the phases of loading from the cylinder 3 up to the launch area, implies the presence of means for guiding the target 5 so that its position is controlled.

Thus, in the example shown, the guiding surface appears at several places on the machine.

When the target 5 is delivered from the column 4 of the cylinder 3, it reaches a surface that is substantially horizontal and shown as item 16 on the FIG. 4 in the form of a surface receiving the target 5 at the level of column 4 in which it was stacked. Pushing means move the target 5 in the direction of transfer ramp 8 that is also shown in FIG. 4 in the form of a ramp in two parts with different inclinations, the first zone sloping less than the second downstream zone. The ramp 8 enables target 5 to be transferred to the launch zone corresponding to the zone in which is positioned the arm 9. Note that the transfer phase can take place by simply taking advantage of the gravity of the target 5. This example is not limiting and the movement of the target 5 can be assisted by any other means.

At the launch area, the machine also consist of a portion of the guiding surface. One of them is a sidewall 15 formed on the side of the chassis 2 opposite the flap 13. Another sidewall 14 is formed on the inner part of the flap 13. These 2 surfaces are facing each other and could come into contact with different faces of the target 5. The face of the target 5 that may come into contact with the sidewall 14 of the flap 13 has been identified as item 19 on FIG. 3. Advantageously, the contact surfaces previously mentioned are formed on a substantially flat support parallel to the faces of the target 5.

The edge 18 is in turn applied to the supporting surface 11*a*, 11*b* at the launch area and upstream on a chute 12 shown on FIGS. 3 and 4 in a transfer phase.

According to the invention, at least one part of the surfaces in contact with the faces of the target 5 consist of discontinuous zones in contact with the target 5. By discontinuous contact zones is meant the making of contact points, lines or surfaces, at least one part of which is not included in the continuity of the others, separated by zones that do not have any contact with the target 5.

In the illustrated example, the discontinuous contact zones are formed by multiple protuberances 17 on the contact surfaces in the direction of one of the faces 19 of the target 5 so as to bear on the latter without the target/contact surface contact be executed over all the surface of the face corresponding to target 5.

For example, the protuberances 17 with rounded summit of between 5 and 20 mm diameter may be satisfactory. These protuberances 17 are created by stamping sheet metal. However, this example is not restrictive and other forms, including especially reliefs with pointed peaks or chequered surfaces on which the protuberances or intercell peaks are positioned opposite the cells forming the discontinuous contact zones.

An alternative consists in forming perforated zones around the zones in contact with the target, thereby avoiding lengthening the contact. The guiding surfaces can be formed from plate perforated at certain places and retaining contact at other places. A welded steel structure using steel wire would also be suitable for the guiding surfaces.

In a preferred embodiment, the discontinuous contact zones are configured so that the overall surface of the guiding surface in contact with the target 5 does not exceed 50%, and is possibly less than 10%) of the surface of the corresponding face of the target 5.

This limited contact surface is particularly useful in wet or damp conditions by greatly increasing the risk of the target face adhering to the machine, leading to a sort of "sticking" that could even jam the target.

In association with the discontinuous contact zones on the faces of the target 5, the supporting surface 11*a*, 11*b* of the edge 18 is formed advantageously with the friction means so that the friction of the edge 18 on the machine takes place essentially on the edge 18. In this way, through the effect of the arm 9, the target 5 is subjected to a force on the supporting surface 11*a*, 11*b*, causing it to move in the rotational plane of the arm 9 and advantageously generating self-rotation of the target 5 thereby stabilising its trajectory when launched. Simultaneously, reducing the adhesion and the friction of the guiding surface prevents interference with this effect and does not slow down the target 5.

All or part of the supporting surface 11*a*, 11*b* also comprises friction means. The device is configured so that the coefficient of friction of supporting surface 11*a*, 11*b* relative to the target 5 is greater than that of a single flat metal plate or a smooth plastic surface.

The friction means preferably comprise reliefs formed or added to the supporting surface 11*a*, 11*b*.

The reliefs can be of different types installed alternately or in combinations. Furthermore, there is no need for the reliefs to be present over the entire length of the supporting surface.

One possibility is to form reliefs in the form of protuberances projecting from the supporting surface 11*a*, 11*b* in the direction of the target. In the event that the supporting surface is formed on one or several sections of sheet metal, the protuberances can be produced by stamping. Their diameter at the base is for instance, between 8 mm and 20 mm.

The protuberances 17 may comprise holes at their summit achieved by cutting in the metal sheet. The protuberances 17, whether or not perforated, thus form discontinuities in the surface of the supporting surface 11*a*, 11*b* so as to increase the adherence of the edge of the target 5.

The force exerted by the launch arm 9 applies the edge 18 of the target 5 onto the friction means thereby producing high friction, whereas this is low at the faces of the target 5.

According to another possibility, the reliefs are formed by one or more strips of nonslip material. Thus, agglomerated particles embedded in a binder (such as a polymer matrix or other resin) may be laid on the supporting surface 11*a*, 11*b* or added in the form of strip(s) to be bonded on a support.

Moreover, a rough surface can be generated by treating the supporting surface 11*a*, 11*b*. In particular, this may consist in sand blasting or another method of degrading, roughing or scratching the supporting surface 11*a*, 11*b*.

REFERENCES

1. Base
2. Chassis
3. Cylinder
4. Column
5. Target
6. Delivery surface
7. Fairing
8. Transfer ramp
9. Arm
10. Roller
11*a*. Supporting surface
11*b*. Supporting surface
12. Chute
13. Flap
14. Side wall
15. Side wall
16. Receiving surface
17. Protuberances
18. Edge
19. Face
20. Guide

The invention claimed is:

1. Machine for launching disk-shaped targets with two faces placed on either side of edge, comprising a target, an arm for launching the target positioned in a launch area and a surface for guiding the target by contact with at least one of its faces, wherein the guiding surface comprises at least one section in which the zones of contact with the face of the target are discontinuous, a component for storing multiple targets and means for delivering a target from the storage component to a delivery zone, wherein the delivery zone comprises at least one receiving surface forming part of the guiding surface, wherein the receiving surface comprises discontinuous contact zones, wherein the receiving surface and the launch area are connected by a transfer ramp configured so as to guide the transfer of a target towards the launch area by gravitation, the transfer ramp forming part of the guiding surface and comprising discontinuous contact zones, and wherein the discontinuous contact zones comprise zones of protuberances forming relief zones on the transfer ramp of the guiding surface.

2. Machine according to claim 1 wherein the relief zones comprise checkered surfaces.

3. Machine according to claim 1 wherein the discontinuous contact zones comprise zones surrounded by perforated zones.

4. Machine according to claim 1 wherein the launch area comprises a surface supporting the edge of a target and at least one side wall, forming part of the guiding surface and comprising discontinuous contact zones.

5. Machine according to claim 4 wherein the launch area comprises two side walls configured to co-act with the different faces of a target and forming part of the guiding surface and comprising discontinuous contact zones.

6. Machine according to claim 4 wherein the supporting surface of the edge of a target comprises friction means.

7. The machine according to claim 1, wherein the discontinuous contact zones comprise zones of protruberances forming a relief zone on the guiding surface.

* * * * *